US008939331B2

(12) United States Patent
Ackermann et al.

(10) Patent No.: US 8,939,331 B2
(45) Date of Patent: Jan. 27, 2015

(54) SLIDING CLOSURE FOR A METALLURGICAL CONTAINER

(75) Inventors: Phillipp Ackermann, Root (CH); Werner Keller, Steinhausen (CH); Angelo Zingre, Hochdorf (CH)

(73) Assignee: Stopinc Atkiengesellschaft, Hunenberg (CH)

( * ) Notice: Subject to any disclaimer, the term of this patent is extended or adjusted under 35 U.S.C. 154(b) by 287 days.

(21) Appl. No.: 13/517,071

(22) PCT Filed: Dec. 20, 2010

(86) PCT No.: PCT/EP2010/007790

§ 371 (c)(1), (2), (4) Date: Jun. 28, 2012

(87) PCT Pub. No.: WO2011/085787

PCT Pub. Date: Jul. 21, 2011

(65) Prior Publication Data

US 2012/0273532 A1 Nov. 1, 2012

(30) Foreign Application Priority Data

Dec. 21, 2009 (CH) ..... 2016/09

(51) Int. Cl.

| | |
|---|---|
| ***B22D 41/22*** | (2006.01) |
| ***B22D 41/24*** | (2006.01) |
| ***B22D 41/34*** | (2006.01) |

(52) U.S. Cl.

CPC ..... *B22D 41/24* (2013.01); *B22D 41/34* (2013.01)

USPC ..... 222/600; 222/597

(58) Field of Classification Search

USPC ..... 222/600, 590, 591, 597

See application file for complete search history.

(56) References Cited

U.S. PATENT DOCUMENTS

| | | | | |
|---|---|---|---|---|
| 4,561,573 | A * | 12/1985 | Shapland | 222/600 |
| 4,582,232 | A * | 4/1986 | Shapland et al. | 222/600 |
| 4,921,148 | A | 5/1990 | Muller | |
| 5,421,563 | A | 6/1995 | Holtermann et al. | |
| 5,961,873 | A | 10/1999 | Keller | |
| 6,422,435 | B1 | 7/2002 | Toaldo | |

FOREIGN PATENT DOCUMENTS

| | | |
|---|---|---|
| DE | 3500865 A1 | 7/1986 |
| DE | 3500866 A1 | 7/1986 |
| EP | 0891829 B1 | 3/2003 |
| EP | 1119428 B1 | 9/2004 |

* cited by examiner

*Primary Examiner* — Scott Kastler

(74) *Attorney, Agent, or Firm* — Brian Roffe

(57) ABSTRACT

The invention relates to a sliding closure (1) for a metallurgical container, comprising two fireproof closing plates (3; 5), of which one is arranged in a slide unit (6) and is used to open and close a spout opening (10). The other closing plate (3) is arranged in a metal housing (2) that can be fastened to the container. Said stationary housing (2) and the slide unit (6) also accommodate an upper fireproof inlet sleeve (4) on the container side and a lower fireproof spout sleeve (8). In the housing (2) and in the slide unit (6), at least one additional inner part (2*a*, 2*a'*, 7*a*) is arranged in each case, each additional inner part enclosing the spout sleeve (8) or the inlet sleeve (4). Thus, thermal stresses in the slide unit or in the housing can be reduced and the risk of cracks forming can be significantly reduced.

20 Claims, 2 Drawing Sheets

SLIDING CLOSURE FOR A METALLURGICAL CONTAINER

FIELD OF THE INVENTION

The invention relates to a sliding closure for a metallurgical container including at least two fireproof closing plates, one of which is arranged in a metallic slide unit and used to open and close a spout opening and the other of which is arranged in a metallic housing fastenable to the container, the housing and/or the slide unit additionally accommodating an upper fireproof inlet sleeve on the container side and/or a lower fireproof spout sleeve.

BACKGROUND OF THE INVENTION

Sliding closures of this type are known in various configurations. Publication EP 1 119 428 discloses, for example, a sliding closure comprising two fireproof closing plates with a metallic housing that can be fastened to the container and which accommodates the upper closing plate and a fireproof inlet sleeve on the container side. The lower closing or slide plate serving to open and close a spout opening is arranged in a metallic slide unit which additionally accommodates a fireproof spout sleeve adjoining the slide plate.

It is well known that the fireproof parts of the sliding closure, in particular the two closing plates, but also the inlet sleeve on the container side and the spout sleeve adjoining the slide plate such as to form a seal are subjected to a high degree of wear and tear, and so have to be changed regularly.

However, the high temperatures occurring during casting also subject the housing accommodating the inlet sleeve and the upper closing plate as well as the slide unit containing the slide plate and the spout sleeve to a high degree of stress, in particular in the region lying close to the flow-through opening and enclosing the spout sleeve and the inlet sleeve, where the highest temperatures prevail and so the greatest stresses occur. In addition, the sliding closure experiences a high degree of heating from below, and so in particular this slide unit accommodating the spout sleeve is subjected to an extremely high degree of thermal stress.

The same problem also arises with sliding closures which comprise a slide plate that can be displaced between two stationary closing plates (see e.g. EP 0 891 829 A1) in which the housing that can be fastened to the container also accommodates the inlet sleeve as well as the spout sleeve and the casting pipe in addition to the two stationary closing plates.

OBJECTS AND SUMMARY OF THE INVENTION

The object underlying the present invention is to provide a sliding closure of the type specified at the start which better withstands the high temperatures occurring during casting.

According to the invention the object is achieved by a sliding closure including a bracing component that braces a spout sleeve to a closing plate, a slide unit that includes an inner part arranged around the spout sleeve and an outer part arranged around the inner part, which inner part is detachably connected to the outer part and thermally expandable with respect to the outer part, and wherein one region of the inner part engages with the bracing component and another region of the inner part defines one side of a radial air gap, another side of the radial air gap being defined by an outer surface of the spout sleeve, the radial air gap forming a temperature barrier between the spout sleeve and the slide unit.

Further preferred configurations of the sliding closure according to the invention form the subject matter of the dependent claims.

Since according to the invention the housing that can be fastened to the container and/or the slide unit is provided with an inner part enclosing the spout sleeve and the inlet sleeve and which is detachably connected to the other part of the housing or the slide unit and is thermally expandable with respect to the latter, the stresses in the slide unit or in the housing are dissipated at the points where the highest temperatures prevail, and the risk of cracks occurring is considerably reduced.

In sliding closures equipped with two or more closing plates, it is in particular the slide unit which is additionally subjected to a high degree of heating from below and can be effectively protected by the two-part configuration according to the invention.

However, the invention can also be used in sliding closures which comprise two stationary closing plates and a slide plate that can be displaced between the latter. Here it is the housing that can be fastened to the container that accommodates the spout sleeve (or a casting pipe) in its lower region and is subjected to particularly strong heating from below. According to the invention this housing can be formed from two parts, at least in the region enclosing the spout sleeve, and have a thermally expandable inner part.

BRIEF DESCRIPTION OF THE DRAWINGS

In the following the invention is described in more detail by means of the drawings. These show as follows.

DETAILED DESCRIPTION OF THE INVENTION

Figure 1:
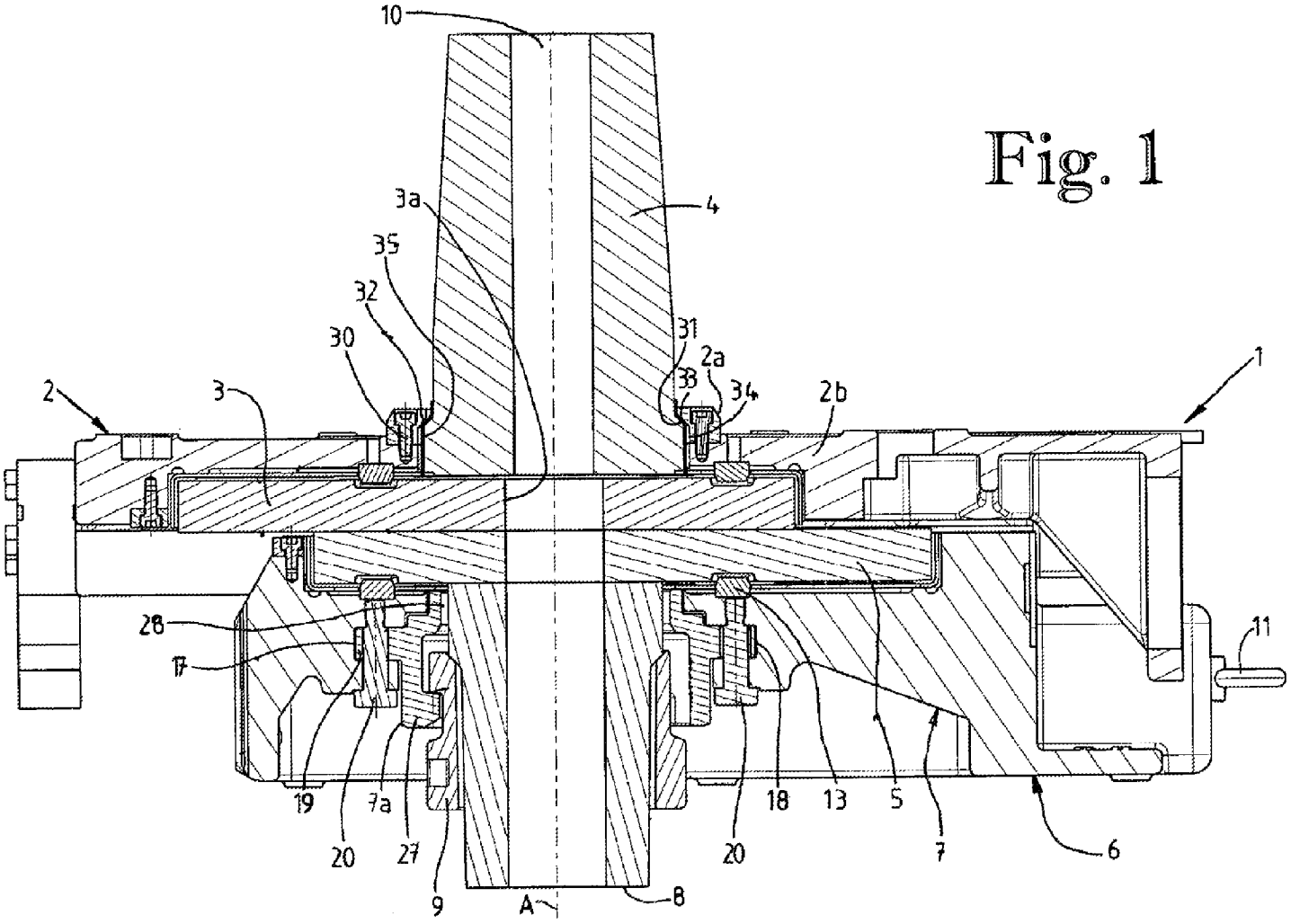
FIG. 1 is a longitudinal section of an exemplary embodiment of the sliding closure according to the invention.

FIG. 1 shows a sliding closure 1 for a metallurgical container which can be, for example, a ladle for molten steel used in a continuous casting plant. The container itself can not be seen from the drawing. The sliding closure 1 has a metallic housing 2 that can be fastened to a container in which an upper closing plate 3 made of a fireproof material is held, pressed against an inlet sleeve 4 on the container side that is also fireproof, which is introduced into a perforated brick of the container (not shown).

A further lower closing plate 5—a so-called slide plate—is held in a longitudinally moveable metallic slide unit 6 of the latter and in a way known in its own right, for example from EP 1 119 428, and so not described in any more detail, is pressed against the upper closing plate 3. Furthermore, a fireproof spout sleeve 8 adjoining the slide plate 5 is arranged in the slide unit 6 and is pressed against the slide plate 5 by means of a bracing component 9. By displacing the slide unit 6 and the slide plate 5 inserted into the latter from the open position shown in FIG. 1 into a restricting or closed position, the spout opening 10 defined by the inlet sleeve 4 and the upper closing plate 3 with its through hole 3*a* can be partially or totally closed. In FIG. 1 the connection 11 of the slide unit 6 to a linear drive bringing about the displacement is indicated.

The two closing plates 3, 5 are centered in the respective housing by means of centering components 13 in a way known in its own right and not described in any further detail.

According to the invention the slide unit 6 accommodating the slide plate 5 and the spout sleeve 8 is provided with an inner part 7*a* enclosing the spout sleeve 8 and which is detachably connected to the other part 7*b* of the slide unit 6 and is thermally expandable with respect to the latter.

Figure 2:
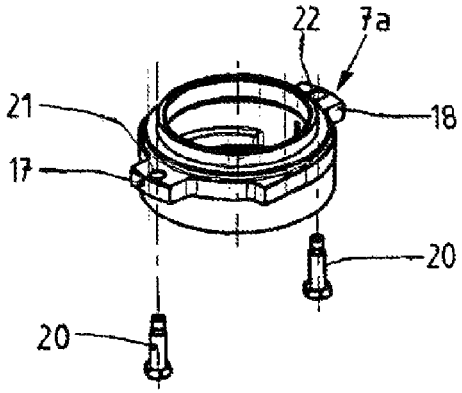
FIG. 2 is a perspective exploded view of part of the sliding closure according to FIG. 1.

In the exemplary embodiment shown the inner part 7*a*, which can also be seen in FIG. 2, has two diametrically opposing flange parts 17, 18, with which it can be introduced into corresponding grooves 19 of the rest of the slide unit 7*b* and then can be screwed to the latter. For this purpose fitted shoulder screws 20 and for the latter a fitted opening 21 in the one flange part 17 and a slot hole 22 in the other flange part 18 are preferably provided. Whereas positioning is achieved by means of the one fitted shoulder screw 20 and the fitted opening 21 of the inner part, which is connected, in the manner of a bayonet, in its lower region 27 to the aforementioned bracing component 9 for bracing the spout sleeve 8 with the closing plate 5 lying over it, the slot hole 22 allows thermal expansion of the inner part 7*a* transversely to axis A of the spout opening 10. Between the inner part engaging on the bayonet ring 9 from the outside and the spout sleeve 8 there is a radial air gap 28 which forms a type of temperature barrier between the spout sleeve 8 and the two-part slide unit 6.

The fitted shoulder screws 20 screwed into the slide unit 6 are advantageously arranged in a longitudinal centre plane of the sliding closure. Preferably, the flange part 22 of the inner part, which upon displacing the slide unit 6 into the closed position lies closer to axis A of the spout opening, is provided with the slot hole 22 for the fitted shoulder screw 20, and so, for example in a restricting position of the sliding closure, is subjected to the higher temperature.

In the exemplary embodiment shown in FIG. 1 the housing 2 that can be fastened to the container is also formed in two parts and is provided with a preferably annular inner part 2*a* enclosing the inlet sleeve 4. This inner part 2*a* serving as a wearing ring is detachably connected to the rest of the housing 2*b* by means of a number of axially directed fastening bolts 30 distributed around the circumference. The inner part 2*a* has a conical upwardly tapering inner surface 31 which lies on a conical upwardly tapering outer platform surface 32 of the inlet sleeve 4. Cylindrical inner surfaces 33, 34 adjoin the conical inner surface 31, there being a radial air gap 35 between these cylindrical inner surfaces 33, 34 and the outer circumference of the inlet sleeve 4.

Since the housing 2 that can be fastened to the container, above all, however, the housing frame 7 of the slide unit 6, is formed in two parts, and is provided with an inner part 2*a*; 7 enclosing the spout sleeve 8 and the inlet sleeve 4, with which air gaps are formed and thermal expansion is made possible, at those points where the highest temperatures prevail the stresses within the housing frame 7 and within the housing 2 are dissipated, and the risk of cracks occurring is considerably reduced. In sliding closures equipped with two closing plates it is the slide unit 6 which is additionally subjected to strong heating from below and can be effectively protected by the two-part configuration according to the invention.

Figure 3:
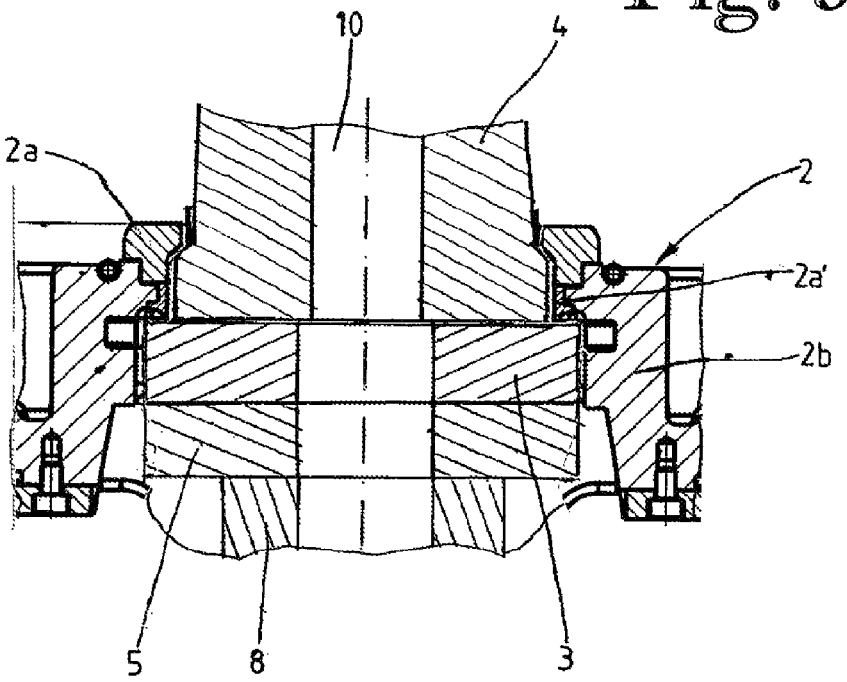
FIG. 3 is part of the sliding closure according to FIG. 1 in cross-section along the axis of the flow-through opening.

According to FIG. 3 on the one hand this upper inner part 2*a* in the form of a ring and centering the inlet sleeve 4 and on the other hand an inner part 2*a*' contained in the housing 2 and partially surrounding the inlet sleeve 4 are provided. This inner part 2*a*' is formed in two parts and is advantageously arranged a distance away from the inlet sleeve 4.

The idea of the invention can also be applied, however, to sliding closures which comprise two stationary closing plates and a slide plate displaceable between the latter. Here it is the housing that can be fastened to the container which in its lower region accommodates the spout sleeve (or a casting pipe) and is subjected to particularly strong heating from below. According to the invention this housing can be formed in at least two parts in the region enclosing the spout sleeve and have a thermally expandable inner part. Needless to say this housing could however also be equipped with a further inner part in the region of the inlet sleeve.

Grey cast iron or spheroidal cast iron is particularly suitable as a housing material. The inner parts 7*a*, 2*a* and the other housing parts 7*b*, 2*b* can also be made of different materials here. The fastening means such as e.g. the fitted shoulder screws 20 are also made of the most temperature-resistant material possible.

The invention claimed is:

1. A sliding closure for a metallurgical container from which material flows through a spout opening, comprising:

a housing adapted to be fastened to the container;

a first closing plate arranged in said housing and including a through hole aligning with the spout opening defined by the sliding closure;

a slide unit;

a second closing plate arranged in said slide unit and including a through hole, said second closing plate being movable to selectively align said through hole of said second closing plate with or close said through hole of said first closing plate;

a spout sleeve defining a through channel aligning with said through hole of said second closing plate; and a bracing component that braces said spout sleeve to said second closing plate;

said slide unit comprising an inner part arranged around said spout sleeve and an outer part arranged around said inner part, said inner part being detachably connected to said outer part and being thermally expandable with respect to said outer part, one region of said inner part engaging with said bracing component and another region of said inner part defining one side of a radial air gap, another side of said radial air gap being defined by an outer surface of said spout sleeve, said radial air gap forming a temperature barrier between said spout sleeve and said slide unit.

2. The sliding closure of claim 1, further comprising an inlet sleeve defining a through channel aligning with said through hole of said first closing plate, said housing comprising an inner housing part arranged around said inlet sleeve and an outer housing part arranged around said inner housing part.

3. The sliding closure of claim 2, wherein said inner housing part is annular and is arranged coaxially to said inlet sleeve, further comprising fasteners that fasten said inner housing part and said outer housing part together.

4. The sliding closure of claim 2, wherein said inner housing part surrounds said inlet sleeve and comprises a plurality of subparts.

5. The sliding closure of claim 2, wherein said inner housing part includes a conical, upwardly tapering inner surface that lies on a conical, upwardly tapering outer platform surface of said inlet sleeve.

6. The sliding closure of claim 5, wherein said inner housing part includes cylindrical inner surfaces adjoining said conical inner surface, another radial air gap being defined between said cylindrical inner surfaces and an outer circumferential surface of said inlet sleeve.

7. The sliding closure of claim 1, wherein said inner part is annular and is arranged coaxially to said spout sleeve, further comprising fasteners that fasten said inner part and said outer part together.

8. The sliding closure of claim 7, wherein said inner part is configured to thermally expand in at least one direction and comprises two diametrically opposed flange parts, said outer part including grooves that accommodate said flange parts.

9. The sliding closure of claim 8, wherein said fasteners comprise screws, a first one of said flange parts including an aperture dimensioned to engage with one of said screws, a second one of said flange parts including a slot hole dimensioned to engage with another one of said screws and allowing for thermal expansion of said inner part in a direction transverse to an axial direction of the spout opening.

10. The sliding closure of claim 9, wherein said screws are fitted shoulder screws and are arranged in a longitudinal center plane of the sliding closure.

11. The sliding closure of claim 9, wherein said second one of said flange parts lies closer to an axis of the spout opening upon displacement of said slide unit that said first one of said flange parts.

12. The sliding closure of claim 1, wherein said bracing component comprises a bayonet ring.

13. The sliding closure of claim 1, wherein said bracing component has an upper surface in contact with said spout sleeve and an outer surface in contact with said one region of said inner part of said slide unit.

14. The sliding closure of claim 1, wherein said housing is a metallic housing, said slide unit is a metallic slide unit and said first and second closing plates are fireproof closing plates.

15. The sliding closure of claim 1, wherein said inner part comprises flange parts and said outer part comprises grooves configured to receive said flange parts.

16. The sliding closure of claim 15, further comprising fasteners that detachably connect said inner part and said outer part together.

17. A sliding closure for a metallurgical container from which material flows through a spout opening, comprising:

a housing;

a closing plate arranged in said housing and including a through hole aligning with the spout opening defined by the sliding closure;

a spout sleeve defining a through channel aligning with said through hole of said closing plate; and a bracing component that braces said spout sleeve to said closing plate;

said housing comprising an inner part arranged around said spout sleeve and an outer part arranged around said inner part, said inner part being detachably connected to said outer part and being thermally expandable with respect to said outer part, one region of said inner part engaging with said bracing component and another region of said inner part defining one side of a radial air gap, another side of said radial air gap being defined by an outer surface of said spout sleeve, said radial air gap forming a temperature barrier between said spout sleeve and said housing.

18. The sliding closure of claim 17, wherein said housing is a slide unit, said closing plate being movable to selectively allow or prevent flow of material through said spout sleeve.

19. The sliding closure of claim 17, wherein said inner part comprises flange parts and said outer part comprises grooves configured to receive said flange parts.

20. The sliding closure of claim 19, further comprising fasteners that detachably connect said inner part and said outer part together.

* * * * *